US007389954B1

(12) United States Patent
Quadrana

(10) Patent No.: US 7,389,954 B1
(45) Date of Patent: Jun. 24, 2008

(54) FOOD GRINDER

(76) Inventor: Marcello Quadrana, Via Weber, 4, Bologna (IT) 40138

( * ) Notice: Subject to any disclaimer, the term of this patent is extended or adjusted under 35 U.S.C. 154(b) by 0 days.

(21) Appl. No.: 09/322,248

(22) Filed: May 28, 1999

Related U.S. Application Data

(63) Continuation-in-part of application No. 08/962,824, filed on Nov. 3, 1997, now abandoned.

(51) Int. Cl.
*B02C 19/12* (2006.01)

(52) U.S. Cl. ..... 241/74; 241/260.1

(58) Field of Classification Search ..... 241/74, 241/260.1
See application file for complete search history.

(56) References Cited

U.S. PATENT DOCUMENTS

| | | | |
|---|---|---|---|
| 2,582,244 | A | 1/1952 | Faith-Ell |
| 4,104,958 | A | 8/1978 | Manser et al. |
| 4,236,676 | A | 12/1980 | Bialski et al. |
| 4,546,927 | A | 10/1985 | Bloome et al. |
| 4,997,137 | A | 3/1991 | Tolonen |
| 5,232,170 | A | 8/1993 | Yang |
| 5,289,979 | A | 3/1994 | Lesar |
| 5,397,065 | A | 3/1995 | Shutov |
| 5,577,674 | A | 11/1996 | Altonji et al. |

FOREIGN PATENT DOCUMENTS

| | | |
|---|---|---|
| DE | 195 16 716 A1 | 6/1995 |
| NL | 603 536 | 8/1934 |
| NL | 1 632 132 | 10/1967 |

*Primary Examiner*—Mark Rosenbaum
(74) *Attorney, Agent, or Firm*—Modiano & Associati; Albert Josif; Daniel J. O'Byrne

(57) ABSTRACT

A food grinding machine comprises a static outer jacket provided with conventional elements for coupling to a loading inlet of the grinding machine. Annular recesses are formed in the internal thickness of the jacket, have preset volumes and are mutually separated. A food pusher and cutter element is mounted inside the jacket so that it rotates coaxially, and a screening element with differentiated passage regions is interpose between the pusher and the jacket. Each region can be crossed at the annular recesses.

20 Claims, 4 Drawing Sheets

FOOD GRINDER

RELATED APPLICATION

This is a continuation-in-part application of application Ser. No. 08/962,824, entitled "Cutting Assembly For Food Grinding Machines", filed on Nov. 3, 1997 by M. Quadrana, now abandoned.

FIELD OF THE INVENTION

The present invention relates to a cutting assembly food grinding machines.

BACKGROUND OF THE INVENTION

Conventional grinding machines used in the alimentary field are essentially constituted by a screw feeder, which is inserted in a specifically provided cylindrical seat arranged downstream of an inlet, is turned by a specifically provided motor and conveys the food towards a plurality of blades which rotate coaxially thereto, are fitted on the same driving shaft as the screw feeder, are grouped in a pack and are alternated with perforated screening diaphragms.

The diaphragms are arranged in a gradually decreasing sequence as regards both the density of the holes that affect each diaphragm and the diameter of the holes, so as to gradually provide, as the food advances outwards, a progressively finer reduction of the particle size of the mass.

However, especially in the processing of very dense food or of food having a fleshy pulp, the resistance that occurs when the mass passes between the diaphragms generates a very intense pressure, which is transmitted and distributed to said diaphragms, to the rotating blades and to the screw feeder.

Accordingly, this entails, especially in the industrial use of grinding machines, the use of motors with a high power rating, even as high as 70 HP, in order to overcome the resistance opposed by the mass being processed.

As a further consequence, there is provided a gradual deterioration not only of the sharpness of the blades but also of their structure, which by wearing very quickly require their replacement on the average every 4-5 working hours in addition to releasing microscopic fragments into the food.

Another problem of the known art in this field is the fact that in the diaphragms, the perforations that allow passage through them are distributed on each diaphragm with a decreasing density with respect to their surfaces, and this worsens the problem of the pressure applied by the food mass.

SUMMARY OF THE INVENTION

The principal aim of the present invention is to solve the above problems of the known art by providing an improved cutting assembly for food grinding machines which substantially reduces the pressure produced during processing, eliminates the possibility of releasing structural particles into the food and maintains a constant density of the distribution of the holes as the screening capacity gradually becomes finer.

This aim, these objects and others are achieved by an improved cutting assembly for food grinding machines, characterized in that it comprises a static outer jacket provided with conventional means for coupling to the loading inlet of a grinding machine, annular recesses being formed in the internal thickness of said jacket, said recesses having preset volumes and being mutually separated, a food pushed element being mounted inside said jacket so that it rotates coaxially, a screening means with differentiated passage regions being interposed between said pusher and said jacket, each region acting at said annular recesses.

BRIEF DESCRIPTION OF THE DRAWINGS

Further characteristics and advantages will become apparent from the description of a preferred embodiment of a cutting assembly for food grinding machines, illustrated only by way of non-limitative example in the accompanying drawings, wherein.

DETAILED DESCRIPTION OF THE INVENTION

Figure 1:
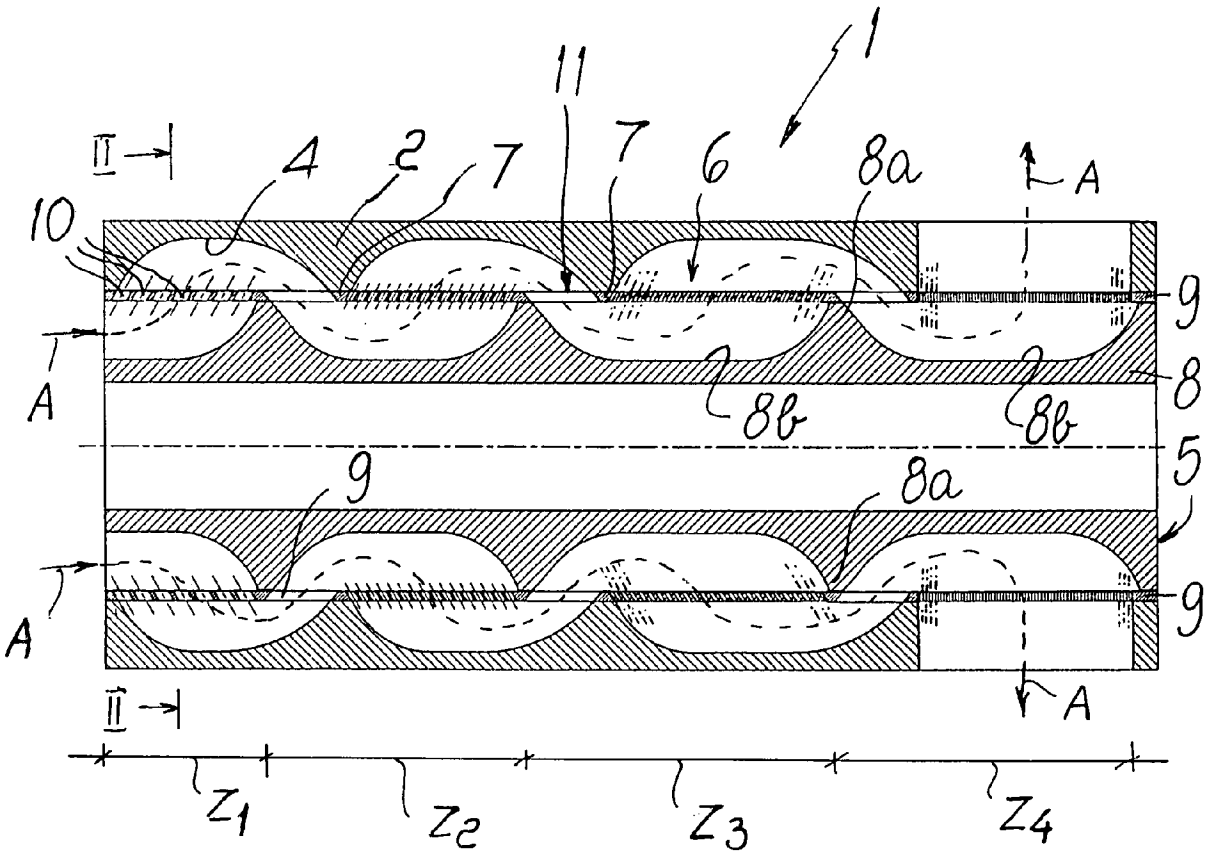
FIG. 1 is a longitudinal sectional view of a first embodiment of the present invention showing the essentials of the cutter assembly.
Figure 2:
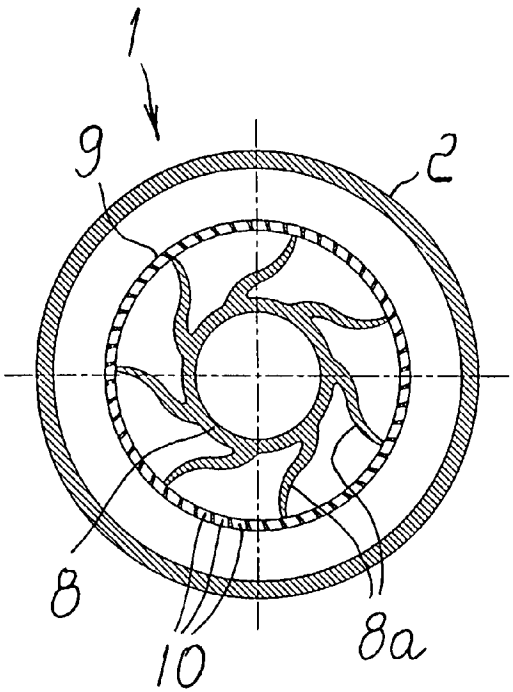
FIG. 2 is a transverse sectional view, taken along the plane II-II of FIG. 1.

With particular reference to the above Figures, the reference numeral 1 generally designates the cutting assembly for food grinding machines, which comprises a static outer jacket 2 provided with conventional means 3 for coupling to a loading inlet of a grinding machine, which is not illustrated since it is of a conventional kind.

A plurality of annular recesses 4 is formed in the internal thickness of the jacket 2; the recesses have preset volumes and are mutually separated.

A food cutter and pusher element 5 is mounted inside the jacket 2 so as to rotate coaxially and is supported in the grinding machine through conventional means which are adapted to keep it constantly centered; a screening means 6 is interposed between the cutter and pusher element 5 and the jacket 2 and is divided into differentiated passage regions $Z_1$, $Z_2$, $Z_3$ and $Z_4$, each of which can be crossed at each annular recess 4.

All of the recesses have a transverse cross-section with rounded edges which are blended with the concurrent ones by means of a respective convex profile 7, so as to define a forced path for the food, on which the screening means 6 rests and is locked.

The cutter and pusher element 5 is constituted, as shown in FIGS. 2 and 4 and 5-6, respectively, in detail by screw feeder blade elements 8 separated by annular ridges 8*e*. The helical edges 8*a* of the blades extend between two consecutive ridges 8*e*, are advantageously sharp and rotate so as to skim the internal surface of the screening means 6.

Figure 5:
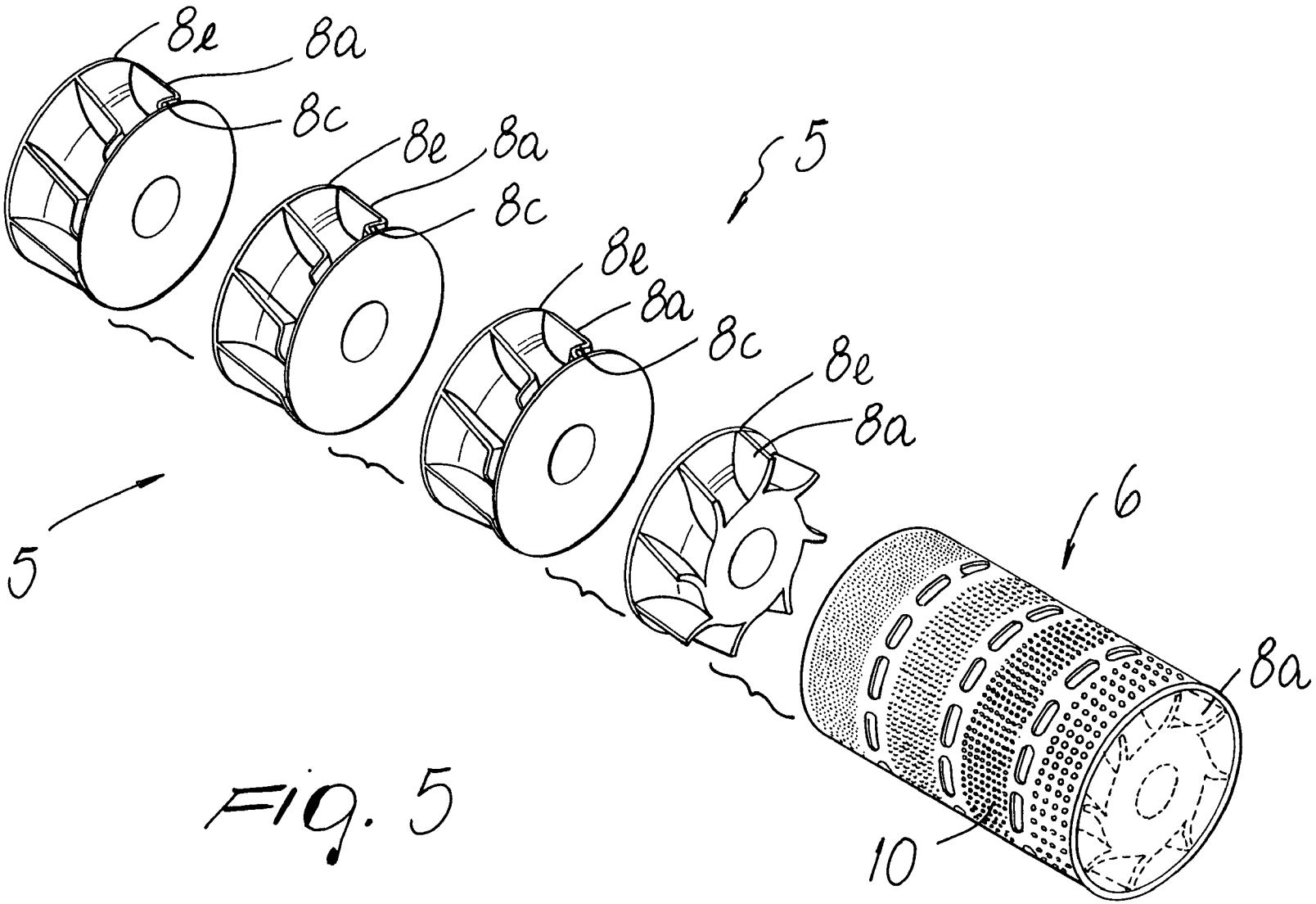
FIG. 5 is a perspective, exploded view of a cutter element and screening means according to the embodiment of the cutter assembly of FIG. 1.

Each one of the blade elements 8 is preferably fabricated as a separate piece, as shown in FIG. 5, by known methods. Such separate elements are eventually jointed to each other, at the ridges 8*e*, so as to obtain the cutter element 5, shown in FIG. 1. The number of blades may be any according to the dimensions of the machine. In the embodiments of the FIGS. 7 and respectively 8, equidistant blades are shown.

The screening means is constituted by a thin cylindrical body 9, the surface of which is affected by contiguous bands of sets of through holes 10, separated by collars with slots of suitable shapes 11, which constitute the differentiated passage regions $Z_1$, $Z_2$, $Z_3$, $Z_4$ in which the ratio between the continuous surface and the perforated surface is constant throughout.

Figure 3:
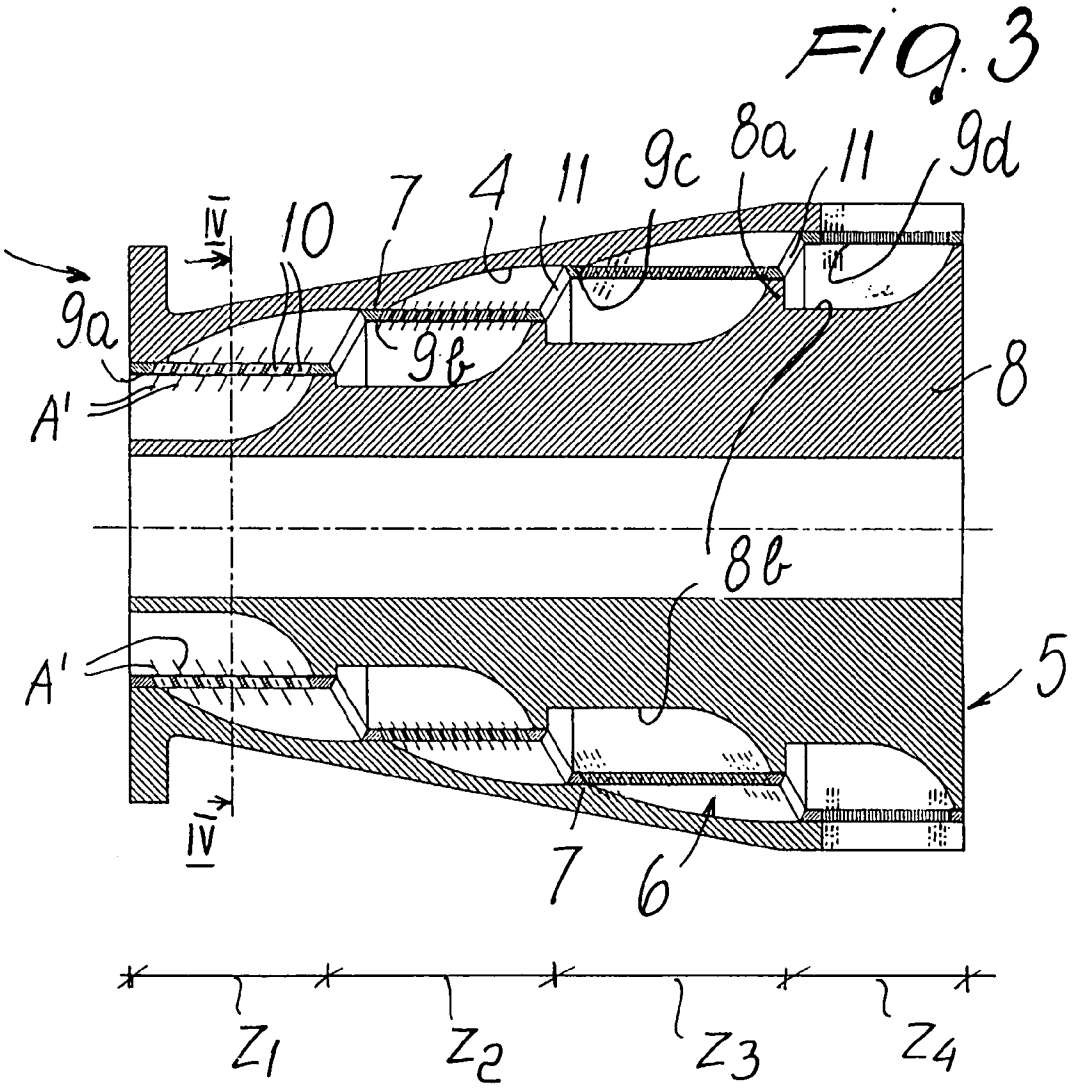
FIG. 3 is a sectional view of a second embodiment of the present invention showing the essentials of the cutter assembly.
Figure 4:
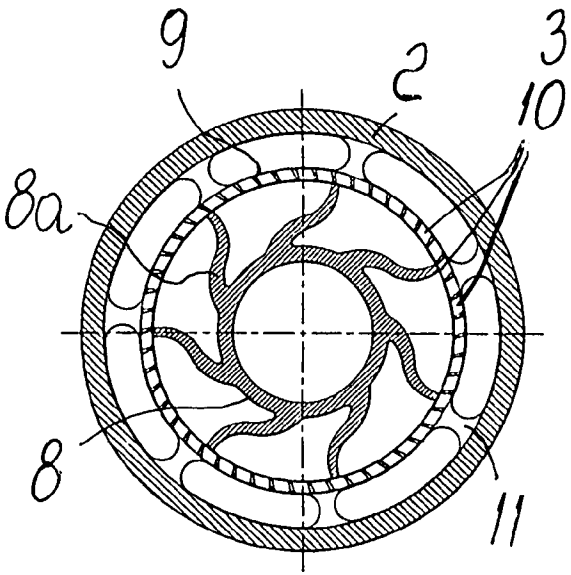
FIG. 4 is a transverse sectional view, taken along the plane IV-IV of FIG. 3.

In a possible alternative embodiment, the static outer jacket 2 can flare outwards, as shown in FIG. 3. Accordingly, the screw feeder blade elements 8 see FIG. 6) also have suitably increasing cross-sectional dimensions, corresponding to the jacket flaring, and so does the interposed cylindrical body 9 that constitutes the screening means 6, which in this case is constituted by the coaxial and sequential joining of a plurality of cylinders 9*a*, 9*b*, 9*c*, 9*d* whose diameters gradually increase outwards; each cylinder defines one of the regions $Z_1$, $Z_2$, $Z_3$, $Z_4$, and the cylinders are mutually joined by means of corresponding perforated collars with slots 11.

In this case, too, each one of the cylinders 9*a*, 9*b*, 9*c*, 9*d* has lateral surfaces affected by the corresponding sets of through holes 10 whose diameters decrease for each cylinder, so that the ratio between the perforated surface and the continuous surface is constant for each cylinder.

In order to better facilitate the advancement of the mass of processed food, the axis A' of the holes 10 is directed towards the outlet.

The operation of the present invention can be easily deduced from the above description: the food to be ground is introduced normally in the grinding machine through a hopper and passes from there into the seat in which the conventional screw feeder rotates; the cutting assembly 1 is installed coaxially at the head of said screw feeder.

The food, after the action of said screw feeder, is pushed further by the screw feeding effect of the blade elements 8, which rotate with the helical edges 8*a* thereof skimming the cylindrical body 9, while the cutter element 5, on the whole, is kept centered therein with conventional means for supporting it on the machine; at the same time, the food is engaged and cut by said helical edges 8*a*, which are conveniently sharp.

The conveyance motion forces the food to pass through the various regions $Z_1$, $Z_2$, $Z_3$, $Z_4$, following the forced path defined between the annular recesses 4 and the grooves 8*b* which are alternated with the ridges 8*e*, as shown in FIG. 1 by the arrows "A"; in following this path, the mass of food passes through the holes 10, whose diameters gradually decrease along the path, thus providing a gradually finer shredding action.

It should also be noted that the number of the holes 10 for each region Z is such as to maintain a constant ratio between the continuous surfaces of the regions Z and the perforated ones, so as to considerably reduce the pressure applied by the mass of food in passing through them.

Moreover, since the cylindrical body 9 is static, tangential stress, and therefore also abrasion, between the helical edges 8*a* of the blade elements 8 and the cylindrical body 9, in which the regions Z are formed, are also eliminated, and the blades are always centered during rotation. Functional advantages stem also from the fact that the edges 8*a* of the blades of the embodiment of FIG. 5, deviate each, before merging into a respective ridge 8*e* located upstream along the food processing path, to form at each region of a blade element 8 corresponding upon assembly with the collar area having the slots 11, a respective pocket 8*c*. Such pockets 8*c* facilitate receiving of the food processed in its passage from the annular recess 4 of the jacket 2 to the grooves 8*b* formed between the blades.

Figure 6:
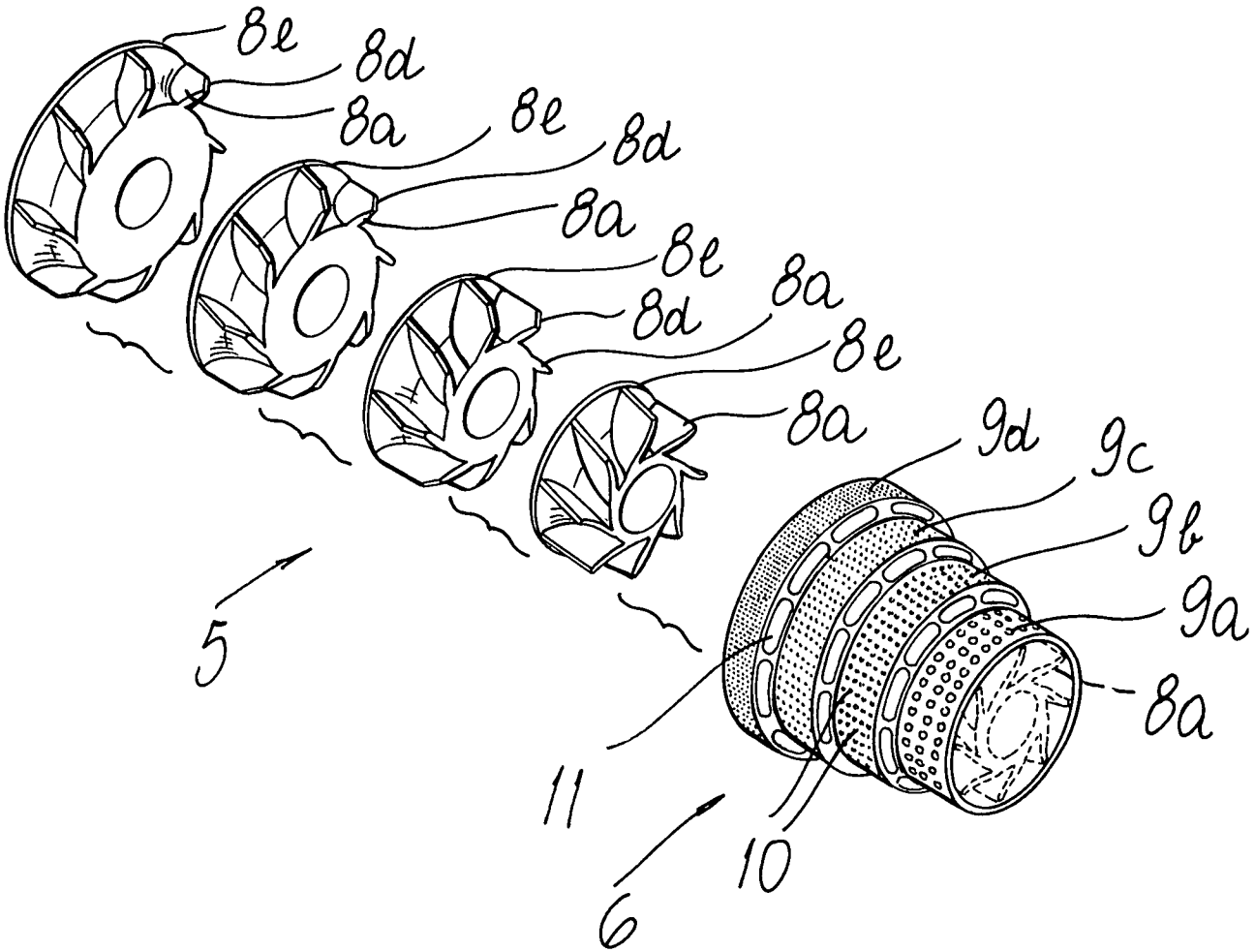
FIG. 6 is a perspective, exploded view of a cutter element and screening means according to the embodiment of the cutter assembly of FIG. 3.

In the embodiment of FIG. 6, the transfer of the food from an annular recess 4 opposed to the grooves of a blade element 8 to the grooves 8*b* of the subsequent blade element 8, is even more facilitated, and food agglomeration risks are practically eliminated by virtue of the flaring configuration of the assembly. Indeed, the food path through a recess 4 and next grooves is almost straight, the slots 11 being arranged crosswise thereat.

The blade edges 8*a* have each, in this embodiment, a bevel located suitably at the end intended to skim over a corresponding slotted collar region 11.

It will be accordingly noted that a processing path with a smooth food transfer is provided which is formed, for both embodiments described, by recesses 4 of the jacket 2, through holes 10 of the screening means, free passage means constituted by the slotted collars 11, and grooves 8*b* of the cutter element 5. The screening means 6, as mentioned above, have, for each of the passage regions $Z_1$, $Z_2$, $Z_3$ and $Z_4$, irrespective of the hole diameters, a constant total holed surface.

It has thus been shown that the described invention achieves the intended aim and objects.

The present invention thus conceived is susceptible of numerous modifications and variations, all of which are within the scope of the inventive concept.

All the details may also be replaced with other technically equivalent elements.

In the practical embodiment of the present invention, the materials used, as well as the shapes and the dimensions, may be any according to the requirements without thereby abandoning the scope of the protection of the appended claims.

What is claimed is:

1. A food grinding machine, comprising:

a static outer jacket including a peripheral wall enclosing an inner space, and being coupleable to a loading inlet of the grinding machine;

a plurality of successive annular recesses being formed in said peripheral wall, said recesses having preset volumes and being separated one from the other;

a food pusher and cutter element being mounted in said inner space for rotation coaxial to said jacket for advancing food along a food processing path;

a plurality of screening means defining differentiated screening passage regions, each of which is formed by sets of through holes provided in sequence along the food processing path for screening processed food, said screening means being interposed between said pusher and cutter element and said jacket and arranged with each one of said sets of through holes in a corresponding relationship with a respective one of said recesses;—a plurality of collar elements, each of which is located between two consecutive sets of holes forming said screening regions, and connects two consecutive screening means; and a plurality of free passage means for allowing free passage of the processed food from a screen passage region to a subsequent screen passage region, said free passage means being constituted by through slots, provided at said collar elements and having such a holed surface so as to allow free, non-screening passage of the food processed from one side of the screening means to the opposite side;

wherein said food processing path includes said plurality of successive recesses, said through slots forming said free passage means, and said plurality of screening means through each of which the processed food is advanced by said pusher and cutter element by being inserted through a said screening means into, and subsequently extracted through a said free passage means out of a said recess and further inserted through a subsequent said screening means into a subsequent said recess.

2. The grinding machine of claim 1, wherein said annular recesses have each a transverse cross section with rounded edges which are blended with concurrent edges with a convex profile to define a forced path for the processed food, each convex profile furthermore acting as supporting and locking element for said screening means.

3. The grinding machine of claim 1, wherein said pusher and cutter element is constituted by blade elements, having sharp helical edges oriented so as to provide a screw feeding effect and to skim an internal surface of said screening means as the blade elements rotate.

4. The grinding machine of claim 1, wherein said plurality of screening means each includes a thin hollow cylindrical body coaxially arranged with respect to said jacket and comprising said sets of through holes distributed on surface regions thereof, said sets of holes defining said differentiated screening passage regions.

5. The grinding machine of claim 4, wherein at each of said differentiated screening passage regions a respective set of through holes is provided with the holes being in such a number and with such a diameter so that a resulting total holed surface is provided for each of said screening passage regions, which is substantially constant.

6. The grinding machine of claim 1, wherein the peripheral wall of said static outer jacket flares outwards.

7. The grinding machine of claim 6, wherein said screening means are constituted by a plurality of successive hollow cylinders having corresponding sets of through holes with diameters decreasing from one cylinder to a subsequent cylinder along said food processing path, said hollow cylinders being arranged mutually coaxial and joined to each other through a respective one of said collar elements, with the diameters of said hollow cylinders increasing along said food processing path.

8. The grinding machine of claim 7, wherein for each of said hollow cylinders, the through holes are in such a number and with such a diameter that the holed surfaces are substantially constant.

9. The grinding machine of claim 8, wherein axes of said through holes are inclined in an orientation along said food processing path.

10. In a food grinding machine, having:

a static outer jacket including a peripheral wall enclosing an inner space, said jacket being coupleable to a loading inlet of the grinding machine; and a plurality of successive annular recesses provided in said peripheral wall, said recesses having preset volumes and being separated one from the other;

a food cutting assembly comprising:

a food pusher and cutter element being mounted in said inner space for rotation coaxial to said jacket, said food pusher and cutter element comprising helical blades adapted to advance processed food along a food processing path;

a plurality of screening means defining differentiated screening passage regions provided in sequence along the food processing path for screening the processed food, said screening means being each formed by a set of through holes and being interposed between said pusher and cutter element and said jacket and arranged with said set of through holes in a corresponding relationship with a respective one of said recesses;

a plurality of collar elements, each of which separating two consecutive screening passage regions and connecting two consecutive respective screening means which define said two consecutive screening passage regions; and a plurality of free passage means for allowing free passage of the processed food from a screen passage region to a subsequent screen passage region, said free passage means being constituted by through slots provided at said collar elements, said through slots having such a holed surface so as to allow free, non-screening passage of the processed food from one side of the screening means to the opposite side;

wherein each one of said set of through holes comprises holes with diameters which vary from a region to another along said food processing path, said holes in each said hole set being in such a number that a resulting total holed surface for each of said screening passage regions is substantially constant.

11. The grinding machine of claim 10, wherein each of said annular recesses has a transverse cross-section with rounded edges which are blended with concurrent edges with a convey profile to define a forced path for the processed food, each convex profile furthermore acting as supporting and locking element for said screening means.

12. The food cutting assembly of claim 10, wherein said blades have sharp helical edges oriented so as to provide a screw feeding effect and to skim an internal surface of said screening means as the blade elements are rotated.

13. The food cutting assembly of claim 10, wherein said plurality of screening means each includes a thin hollow cylindrical body coaxially arranged with respect to said jacket of the grinding machine and comprising said sets of through holes distributed on successive surface regions thereof, said sets of holes defining said differentiated screening passage regions.

14. The grinding machine of claim 10, wherein the peripheral wall of said outer jacket flares outwards.

15. The food cutting assembly of claim 10, wherein said screening means include a plurality of successive hollow cylinders having each a respective one of said sets of through holes with diameters decreasing from one cylinder to a subsequent cylinder along said food processing path, and wherein said hollow cylinders are arranged mutually coaxial, have diameters which increase along said food processing path, and are joined to each other through a respective one of said collar elements.

16. The food cutting assembly of claim 15, wherein axes of said through holes are included in an orientation along said food processing path.

17. In a food grinding machine, having:

a static outer jacket including a peripheral wall enclosing an inner space, said jacket being coupleable to a loading inlet of the grinding machine; and a plurality of successive annular recesses provided in said peripheral wall, said recesses having preset volumes and being separated one from the other;

a food cutting assembly comprising:

a food pusher and cutter element being mounted in said inner space for rotation coaxial to said jacket, said food pusher and cutter element comprising a plurality of consecutive screw feeder blade elements separated by annular ridges, which are adapted to advance processed food along a food processing path;

a plurality of screening means defining differentiated screening passage regions provided in sequence along the food processing path for screening the processed food, said screening means being each formed by a set of through holes and being interposed between said pusher and cutter element and said jacket and arranged with said set of through holes in a corresponding relationship with a respective one of said recesses;

a plurality of collar elements each of which separates two consecutive screening passage regions, said collar elements providing further structural connection between each two consecutive respective screening means which define said consecutive screening passage regions; and a plurality of free passage means for allowing free passage of the processed food from a screen passage region to a subsequent screen passage region, said free passage means being constituted by through slots provided at said collar elements, said through slots having such a holed surface so as to allow free, non-screening passage of the processed food from one side of the screening means to the opposite side.

18. The food cutting assembly of claim 17, wherein said screw feeder blade elements each comprises blades having edges thereof which deviate, before merging into a respective one of said ridges located upstream along said food processing path, to form at each region of a said blade facing a said collar element a respective pocket that facilitates passage of processed food from a said annular recess of said jacket to grooves formed between said blades.

19. The food cutting assembly of claim 18, wherein said plurality of screening means each includes a thin hollow cylindrical body coaxially arranged with respect to said jacket of the grinding machine and comprising said sets of through holes distributed on successive surface regions thereof, said sets of holes defining said differentiated screening passage regions.

20. The food cutting assembly of claim 17, wherein said screening means include a plurality of successive hollow cylinders having each a respective one of said sets of through holes with diameters decreasing from one cylinder to a subsequent cylinder along said food processing path, and wherein said hollow cylinders are arranged mutually coaxial, have diameters which increase along said food processing path, and are joined to each other through a respective one of said collar elements, the peripheral wall of said outer jacket of the grinding machine flaring outwards so as to accommodate said screening means, and wherein said blade elements have blades with edges thereof including beveled regions located at an end of said blade elements which is arranged so as to skim over said collar elements.

* * * * *